US010290408B2

(12) United States Patent
Sagawa et al.

(10) Patent No.: US 10,290,408 B2
(45) **Date of Patent: *May 14, 2019**

(54) NDFEB SYSTEM SINTERED MAGNET

(71) Applicant: INTERMETALLICS CO., LTD., Nakatsugawa-shi, Gifu (JP)

(72) Inventors: Masato Sagawa, Kyoto (JP); Tetsuhiko Mizoguchi, Kyoto (JP)

(73) Assignee: INTERMETALLICS CO., LTD., Nakatsugawa (JP)

( * ) Notice: Subject to any disclaimer, the term of this patent is extended or adjusted under 35 U.S.C. 154(b) by 280 days.

This patent is subject to a terminal disclaimer.

(21) Appl. No.: 15/189,801

(22) Filed: Jun. 22, 2016

(65) Prior Publication Data

US 2016/0300650 A1 Oct. 13, 2016

Related U.S. Application Data

(62) Division of application No. 14/114,653, filed as application No. PCT/JP2012/083789 on Dec. 27, 2012, now Pat. No. 9,412,505.

(30) Foreign Application Priority Data

Dec. 27, 2011 (JP) ..... 2011-286864
Feb. 9, 2012 (JP) ..... 2012-026720

(51) Int. Cl.
*H01F 1/057* (2006.01)
*H01F 41/02* (2006.01)
(Continued)

(52) U.S. Cl.
CPC ..... *H01F 1/0577* (2013.01); *C22C 33/0278* (2013.01); *C22C 38/00* (2013.01);
(Continued)

(58) Field of Classification Search
CPC ..... C22C 2202/02
See application file for complete search history.

(56) References Cited

U.S. PATENT DOCUMENTS 7,618,497 B2 * 11/2009 Kato ..... H01F 1/0577 148/302
9,412,505 B2 * 8/2016 Sagawa ..... H01F 1/057
(Continued)

FOREIGN PATENT DOCUMENTS

CN 1114779 A 1/1996
CN 1698142 A 11/2005
(Continued)

OTHER PUBLICATIONS

Apr. 5, 2017 Office Action issued in European Patent Application No. 12863318.7.

(Continued)

*Primary Examiner* — Scott R Kastler
*Assistant Examiner* — Vanessa T. Luk
(74) *Attorney, Agent, or Firm* — Oliff PLC

(57) ABSTRACT

A NdFeB system sintered magnet produced by the grain boundary diffusion method and has a high coercive force and squareness ratio with only a small decrease in the maximum energy product. A NdFeB system sintered magnet having a base material produced by orienting powder of a NdFeB system alloy and sintering the powder, with Dy and/or Tb (the "Dy and/or Tb" is hereinafter called $R_H$) attached to and diffused from a surface of the base material through the grain boundary inside the base material by a grain boundary diffusion treatment, wherein the difference $C_{gx}$–$C_x$ between the $R_H$ content $C_{gx}$ (wt %) in the grain boundary and the $R_H$ content $C_x$ (wt %) in main-phase grains which are grains constituting the base material at the same depth within a
(Continued)

range from the surface to which $R_H$ is attached to a depth of 3 mm is equal to or larger than 3 wt %.

7 Claims, 8 Drawing Sheets

(51) Int. Cl.

| | |
|---|---|
| ***C22C 38/00*** | (2006.01) |
| ***C22C 33/02*** | (2006.01) |
| *C22C 38/06* | (2006.01) |
| *C22C 38/10* | (2006.01) |
| *C22C 38/16* | (2006.01) |

(52) U.S. Cl.
CPC ..... *H01F 1/057* (2013.01); *H01F 41/0293* (2013.01); *C22C 38/005* (2013.01); *C22C 38/06* (2013.01); *C22C 38/10* (2013.01); *C22C 38/16* (2013.01); *C22C 2202/02* (2013.01)

(56) References Cited

U.S. PATENT DOCUMENTS

| | | | | |
|---|---|---|---|---|
| 2007/0151632 | A1 | 7/2007 | Komuro et al. | |
| 2008/0241368 | A1 | 10/2008 | Komuro et al. | |
| 2008/0241513 | A1 | 10/2008 | Komuro et al. | |
| 2008/0286595 | A1 | 11/2008 | Yoshimura et al. | |
| 2010/0182113 | A1 | 7/2010 | Yoshimura et al. | |
| 2010/0231338 | A1 | 9/2010 | Morimoto et al. | |
| 2010/0282371 | A1 | 11/2010 | Sagawa et al. | |
| 2011/0260816 | A1 | 10/2011 | Morimoto et al. | |
| 2012/0025651 | A1 | 2/2012 | Komuro et al. | |
| 2012/0111232 | A1 | 5/2012 | Komuro et al. | |
| 2012/0176211 | A1 | 7/2012 | Sagawa | |
| 2012/0206227 | A1 | 8/2012 | Yoshimura et al. | |
| 2013/0135069 | A1 | 5/2013 | Miyamoto et al. | |
| 2014/0062632 | A1 * | 3/2014 | Sagawa ..... | H01F 1/0577 335/302 |

FOREIGN PATENT DOCUMENTS

| | | | | |
|---|---|---|---|---|
| CN | 001898757 | A | 1/2007 | |
| CN | 1 983 471 | A | 6/2007 | |
| CN | 101276665 | A | 10/2008 | |
| CN | 101276666 | A | 10/2008 | |
| CN | 101375352 | A | 2/2009 | |
| CN | 101652821 | A | 2/2010 | |
| CN | 101770843 | A | 7/2010 | |
| CN | 101911227 | A | 12/2010 | |
| CN | 102087917 | A | 6/2011 | |
| CN | 102308342 | A | 1/2012 | |
| CN | 102483979 | A | 5/2012 | |
| EP | 1 793 392 | A2 | 6/2007 | |
| EP | 1 923 893 | A1 | 5/2008 | |
| EP | 1 981 043 | A1 | 10/2008 | |
| EP | 2 169 689 | A1 | 3/2010 | |
| EP | 2239747 | A1 | 10/2010 | |
| EP | 2 453 448 | A1 | 5/2012 | |
| JP | 2003-297622 | A | 10/2003 | |
| JP | 2004-256877 | A | 9/2004 | |
| JP | 2008-266767 | A | 11/2008 | |
| JP | 2008-270699 | A | 11/2008 | |
| JP | 2008-305908 | A | 12/2008 | |
| JP | 2011223007 | A | 11/2011 | |
| JP | 4831074 | B2 | 12/2011 | |
| JP | 2012136778 | A | 7/2012 | |
| KR | 20100027111 | A | 3/2010 | |
| WO | 2006043348 | A1 | 4/2006 | |
| WO | 2007/088718 | A1 | 8/2007 | |
| WO | 2009/004794 | A1 | 1/2009 | |
| WO | 2010/109760 | A1 | 9/2010 | |
| WO | 2011004894 | A1 | 1/2011 | |
| WO | 2011/125591 | A1 | 10/2011 | |
| WO | WO-2013100010 | A1 * | 7/2013 | ..... H01F 1/0577 |

OTHER PUBLICATIONS

Jan. 31, 2018 Office Action issued in Chinese Patent Application No. 201510685013.1.
Jul. 7, 2016 Office Action issued in European Patent Application No. 12 863 318.7.
Jan. 5, 2015 Office Action issued in U.S. Appl. No. 14/114,656.
J.M.D. Coey, "Rare-earth Iron Permanent Magnets," Clarendon press, Oxford, pp. 348-353, (1996): 2.2.2 Hydrogen decrepitation (HD).
F. Vial et al., "Improvement of coercivity of sintered NdFeB permanent magnets by heat treatment," Journal of Magnetism and Magnetic Materials 242-245, pp. 1329-1334, (2002).
Jan. 5, 2015 Office Action issued in Chinese Patent Application No. 201280021367.0.
May 14, 2015 Office Action issued in U.S. Appl. No. 14/114,656.
May 20, 2015 Office Action issued in Chinese Patent Application No. 201280021367.0.
Jul. 9, 2015 Office Action issued in European Patent Application No. 12863295.7.
Jul. 9, 2015 Extended European Search Report issued in European Patent Application No. 12863318.7.
Jul. 29, 2015 Office Action issued in European Patent Application No. 12861799.0.
Sep. 14, 2015 Office Action issued in Chinese Patent Application No. 201280021354.3.
Oct. 28, 2015 Office Action issued in Chinese Patent Application No. 201280021381.0.
Jan. 22, 2016 Office Action issued in U.S. Appl. No. 14/114,657.
Mar. 29, 2016 Office Action issued in European Patent Application No. 12863295.7.
May 19, 2016 Office Action issued in U.S. Appl. No. 14/114,657.
Sepehri-Amin, H. et al., "Grain Boundary Structure and Chemistry of Dy-Diffusion Processed; Nd—Fe—B Sintered Magnets," Journal of Applied Physics, May 2010, pp. 09A745.1-09A745.3, vol. 107.
Li, W.F. et al., "Distribution of Dy in High-Coercivity (Nd,Dy)—Fe—B Sintered Magnet," Acta Materialia, Mar. 2011, pp. 3061-3069, vol. 59.
Jun. 30, 2014 Extended European Search Report issued in European Application No. 12861799.0.
Jun. 30, 2014 Extended European Search Report issued in European Application No. 12863295.7.
Jul. 1, 2014 Extended European Search Report issued in European Application No. 12863911.9.
Jul. 8, 2014 Office Action issued in Chinese Patent Application No. 201280021386.3.
Sep. 17, 2014 Office Action issued in Korean Patent Application No. 10-2013-7023817.
Sep. 24, 2013 Office Action issued in Japanese Patent Application No. 2013-536353.
Apr. 16, 2013 International Search Report issued in International Patent Application No. PCT/JP2012/083788.
Apr. 16, 2013 Written Opinion of the International Searching Authority issued in International Patent Application No. PCT/JP2012/083788.
Apr. 16, 2013 International Search Report issued in International Patent Application No. PCT/JP2012/083786.
Apr. 16, 2013 Written Opinion of the International Searching Authority issued in International Patent Application No. PCT/JP2012/083786.
Apr. 16, 2013 International Search Report issued in International Patent Application No. PCT/JP2012/083787.
Apr. 16, 2013 Written Opinion of the International Searching Authority issued in International Patent Application No. PCT/JP2012/083787.
Apr. 16, 2013 International Search Report issued in International Patent Application No. PCT/JP2012/083789.
Apr. 16, 2013 Written Opinion of the International Searching Authority issued in International Patent Application No. PCT/JP2012/083789.
Sep. 24, 2013 Office Action issued in Japanese Patent Application No. 2013-536354.

(56) References Cited

OTHER PUBLICATIONS

U.S. Appl. No. 14/114,657, filed Oct. 29, 2013 in the name of Sagawa et al.
U.S. Appl. No. 14/113,961, filed Oct. 25, 2013 in the name of Sagawa et al.
U.S. Appl. No. 14/114,656, filed Oct. 29, 2013 in the name of Sagawa et al.
Feb. 12, 2014 Office Action issued in Japanese Patent Application No. 2013-536354.
May 8, 2014 Office Action issued in Chinese Patent Application No. 201280021367.0.
May 14, 2015 Office Action issued in U.S. Appl. No. 14/114,653.
Sep. 17, 2014 Office Action issued in Korean Patent Application No. 10-2013-7023816.
Jul. 4, 2017 Office Action issued in Chinese Patent Application No. 201510685013.1.
Jul. 10, 2018 Office Action issued in European Patent Application No. 12 863 911.9.
Aug. 3, 2018 Decision of Rejection issued in Chinese Patent Application No. 201510685013.1.
Jan. 29, 2019 Notification of Contested Trial issued in Chinese Patent Application No. 201510685013.1.

* cited by examiner

C/Nd=5.6% C/Nd=19.6% C/Nd=50.0%

C/Nd=95.6% C/Nd=100% C/Nd=98.6%

NDFEB SYSTEM SINTERED MAGNET

This is a Division of application Ser. No. 14/114,653 filed on Oct. 29, 2013, which in turn is a National Stage Entry of PCT/JP2012/083789 filed on Dec. 27, 2012, which claims the benefit of Japanese Patent Application No. 2012-026720 filed on Feb. 9, 2012 and Japanese Patent Application No. 2011-286864, filed on Dec. 27, 2011. The disclosure of the prior applications is hereby incorporated by reference herein in its entirety.

TECHNICAL FIELD

The present invention relates to a NdFeB system sintered magnet produced by a grain boundary diffusion treatment.

BACKGROUND ART

NdFeB system sintered magnets were discovered by Sagawa (one of the present inventors) and other researchers in 1982. NdFeB system sintered magnets exhibit characteristics far better than those of conventional permanent magnets, and can be advantageously manufactured from raw materials such as Nd (a kind of rare-earth element), iron, and boron, which are relatively abundant and inexpensive. Hence, NdFeB system sintered magnets are used in a variety of products, such as driving motors for hybrid or electric cars, battery-assisted bicycle motors, industrial motors, voice coil motors used in hard disks and other apparatuses, high-grade speakers, headphones, and permanent magnetic resonance imaging systems. NdFeB system sintered magnets used for those purposes must have a high coercive force $H_{cJ}$, a high maximum energy product $(BH)_{max}$, and a high squareness ratio SQ. The squareness ratio SQ is defined as $H_k/H_{cJ}$, where $H_k$ is the absolute value of the magnetic field when the magnetization value corresponding to a zero magnetic field is decreased by 10% on the magnetization curve extending across the boundary of the first and second quadrants of a graph with the horizontal axis indicating the magnetic field and the vertical axis indicating the magnetization.

One method for enhancing the coercive force of a NdFeB system sintered magnet is a "single alloy method", in which Dy and/or Tb (the "Dy and/or Tb" is hereinafter represented by "$R_H$") is added to a starting alloy when preparing the alloy. Another method is a "binary alloy blending technique", in which a main phase alloy which does not contain $R_H$ and a grain boundary phase alloy to which $R_H$ is added are prepared as two kinds of starting alloy powder, which are subsequently mixed together and sintered. Still another method is a "grain boundary diffusion method", which includes the steps of creating a NdFeB system sintered magnet as a base material, attaching $R_H$ to the surface of the base material by an appropriate process, (such as application or vapor deposition), and heating the magnet to diffuse $R_H$ from the surface of the base material into the inner region through the boundaries inside the base material (Patent Document 1).

The coercive force of a NdFeB sintered magnet can be enhanced by any of the aforementioned methods. However, it is known that the maximum energy product decreases if $R_H$ is present in the main-phase grains inside the sintered magnet. In the case of the single alloy method, since $R_H$ is mixed in the main-phase grains at the stage of the starting alloy powder, a sintered magnet created from that powder inevitably contains $R_H$ in its main-phase grains. Therefore, the sintered magnet created by the single alloy method has a relatively low maximum energy product while it has a high coercive force.

In the case of the binary alloy blending technique, the largest portion of $R_H$ will be held in the boundaries of the main-phase grains. Therefore, as compared to the single alloy method, the technique can suppress the decrease in the maximum energy product. Another advantage over the single alloy method is that the amount of use of the rare metal, i.e. $R_H$, is reduced.

In the grain boundary diffusion method, $R_H$ attached to the surface of the base material is diffused into the inner region through the boundaries liquefied by heat in the base material. Therefore, the diffusion rate of $R_H$ in the boundaries is much higher than the rate at which $R_H$ is diffused from the boundaries into the main-phase grains, so that $R_H$ is promptly supplied into deeper regions of the base material. By contrast, the diffusion rate from the boundaries into the main-phase grains is low, since the main-phase grains remain in the solid state. This difference in the diffusion rate can be used to regulate the temperature and time of the heating process so as to realize an ideal state in which the $R_H$ content is high only in the vicinity of the surface of the main-phase grains (grain boundaries) in the base material while the content of the same is low inside the main-phase grains. Thus, it is possible to further minimize the decrease in the maximum energy product $(BH)_{max}$ than in the case of the binary alloy blending technique while enhancing the coercive force. Another advantage over the binary alloy blending technique is that the amount of the rare metal, i.e. $R_H$, used is reduced.

There are two kinds of methods for producing NdFeB system sintered magnets: a "press-applied magnet-production method" and a "press-less magnet-production method." In the press-applied magnet-production method, fine powder of a starting alloy (which is hereinafter called the "alloy powder") is put in a mold, and a magnetic field is applied to the alloy powder while pressure is applied to the alloy powder with a pressing machine, whereby the creation of a compression-molded body and the orientation of the same body are simultaneously performed. Then, the compression-molded body is removed from the mold and sintered by heating. In the press-less magnet-production method, alloy powder which has been put in a predetermined filling container is oriented, and sintered as it is held in the filling container, without undergoing the compression molding.

The press-applied magnet-production method requires a large-size pressing machine to create a compression-molded body. Therefore, it is difficult to perform the process in a closed space. By contrast, in the press-less magnet-production process, which does not use a pressing machine, the processes from the filling through the sintering can be performed in a closed space.

BACKGROUND ART DOCUMENT

Patent Document

Patent Document 1: WO2006/043348
Patent Document 2: WO2011/004894

SUMMARY OF THE INVENTION

Problem to be Solved by the Invention

In the grain boundary diffusion method, the condition of the grain boundary significantly affects the way the $R_H$, which is attached to the surface of the base material by deposition, application or another process, is diffused into the base material, such as how easily $R_H$ will be diffused and how deep it can be diffused from the surface of the base material. One of the present inventors has discovered that a rare-earth rich phase (i.e. the phase containing rare-earth elements in higher proportions than the main-phase grains) in the grain boundary serves as the primary passage for the diffusion of $R_H$ in the grain boundary diffusion method, and that the rare-earth rich phase is preferred to continuously exist, without interruption, through the grain boundaries of the base material in order to diffuse $R_H$ to an adequate depth from the surface of the base material (Patent Document 2).

A later experiment conducted by the present inventors has revealed the following fact: In the production of a NdFeB system sintered magnet, an organic lubricant is added to the alloy powder in order to reduce the friction between the grains of the alloy powder and help the grains easily rotate in the orienting process, as well as for other purposes. The lubricant contains carbon. Although the carbon contents are mostly oxidized during the sintering process and released to the outside of the NdFeB system sintered magnet, a portion of the carbon atoms remains inside the magnet. Among the remaining carbon atoms, those which remain in the grain boundary are cohered together, forming a carbon rich phase (a phase whose carbon content is higher than the average of the entire NdFeB system sintered magnet) in the rare-earth rich phase. The carbon atoms existing in the grain boundaries are more likely to be gathered at a grain-boundary triple point (a portion of the grain boundary surrounded by three or more main-phase grains), where the distance between the main-phase grains is large and impurities can easily gather, than in a two-grain boundary portion (a portion of the grain boundary sandwiched between two main-phase grains), where the distance between the main-phase grains is small and impurities cannot easily enter. Therefore, the largest portion of the carbon rich phase is formed at the grain-boundary triple point.

As already noted, the rare-earth rich phase existing in the grain boundary serves as the primary passage for the diffusion of $R_H$ into the inner region of the NdFeB system sintered magnet. Conversely, the carbon rich phase formed in the rare-earth rich phase acts like a weir which blocks the diffusion passage of $R_H$ and impedes the diffusion of $R_H$ through the grain boundary. If the diffusion of $R_H$ through the grain boundary is impeded, the $R_H$ content in the vicinity of the surface of the NdFeB system sintered magnet increases, and a larger amount of $R_H$ permeates the main-phase grains in the region in the vicinity of the surface, lowering the maximum energy product in that region. In some cases, in order to remove such a region having the lowered maximum energy product, the surface region of the NdFeB system sintered magnet is scraped off after the grain boundary diffusion treatment. However, this is a waste of the valuable element, $R_H$.

Furthermore, since $R_H$ cannot be diffused across the entire magnet, the coercive force and the squareness ratio cannot be sufficiently improved.

The problem to be solved by the present invention is to provide a NdFeB system sintered magnet which is produced by the grain boundary diffusion method and yet has a high coercive force and squareness ratio with only a small decrease in the maximum energy product.

Means for Solving the Problem

A NdFeB system sintered magnet according to the present invention aimed at solving the aforementioned problem is a NdFeB system sintered magnet having a base material produced by orienting powder of a NdFeB system alloy and sintering the powder, with Dy and/or Tb ($R_H$) attached to and diffused from a surface of the base material through the grain boundary inside the base material by a grain boundary diffusion treatment, wherein the difference $C_{gx}-C_x$ between the $R_H$ content $C_{gx}$ (wt %) in the grain boundary and the $R_H$ content $C_x$ (wt %) in main-phase grains which are grains constituting the base material at the same depth within a range from the surface to which $R_H$ is attached to a depth of 3 mm is equal to or larger than 3 wt %.

As already explained, when a carbon rich phase is formed at a grain-boundary triple point, the amount of inflow of $R_H$ into the grain-boundary triple point exceeds the amount of outflow of $R_H$ from the grain-boundary triple point, so that the $R_H$ content in that grain-boundary triple point increases. Due to the decrease in the amount of outflow of $R_H$, the $R_H$ content in a two-grain boundary portion located farther than the grain-boundary triple point from the attachment surface becomes lower than the $R_H$ content in a two-grain boundary portion located closer to the attachment surface than the grain-boundary triple point. Therefore, in a conventional NdFeB system sintered magnet, there is a large difference in the $R_H$ content in the vicinity of the grain-boundary triple point, and $R_H$ is prevented from diffusing into deeper regions. An experiment conducted by the present inventors has demonstrated that, in conventional NdFeB system sintered magnets, the difference between the $R_H$ content in the grain boundary at a depth of 3 mm from the attachment surface and the $R_H$ content in the main-phase grains is approximately 1 wt %.

By contrast, in the NdFeB system sintered magnet according to the present invention, the difference in the $R_H$ content between the grain boundary and the main-phase grains is equal to or larger than 3% at least within a range from the surface to which $R_H$ is attached to a depth of 3 mm. From this fact, it can be said that $R_H$ is mainly diffused through the grain boundary, with only a smaller amount of $R_H$ permeating the main-phase grains. Therefore, the NdFeB system sintered magnet according to the present invention can achieve a higher coercive force and squareness ratio than the conventional NdFeB system sintered magnets by a grain boundary diffusion treatment while suppressing the amount of decrease in the maximum energy product.

In the production of the NdFeB system sintered magnet according to the present invention, for example, the percentage of the total volume of a carbon rich phase in a rare-earth rich phase at the grain-boundary triple points in the base material to the total volume of the rare-earth rich phase should preferably be equal to or lower than 50%. By using such a base material, it is possible to prevent $R_H$ from being blocked by the carbon rich phase during the grain boundary diffusion treatment, and to reduce the amount of $R_H$ permeating into the main-phase grains.

Effect of the Invention

In the NdFeB system sintered magnet according to the present invention, $R_H$ is not localized in the vicinity of the surface but is evenly diffused in the grain boundaries of the entire magnet. Therefore, the NdFeB system sintered magnet according to the present invention can achieve a higher coercive force and squareness ratio than the conventional NdFeB system sintered magnets by a grain boundary diffusion treatment while suppressing the amount of decrease in the maximum energy product.

BEST MODE FOR CARRYING OUT THE INVENTION

One example of the NdFeB system sintered magnet according to the present invention and its production method is hereinafter described.

EXAMPLE

A method for producing a NdFeB system sintered magnet according to the present example and a method according to a comparative example are hereinafter described by means of the flowcharts of FIGS. 1 and 2.

Figure 1:
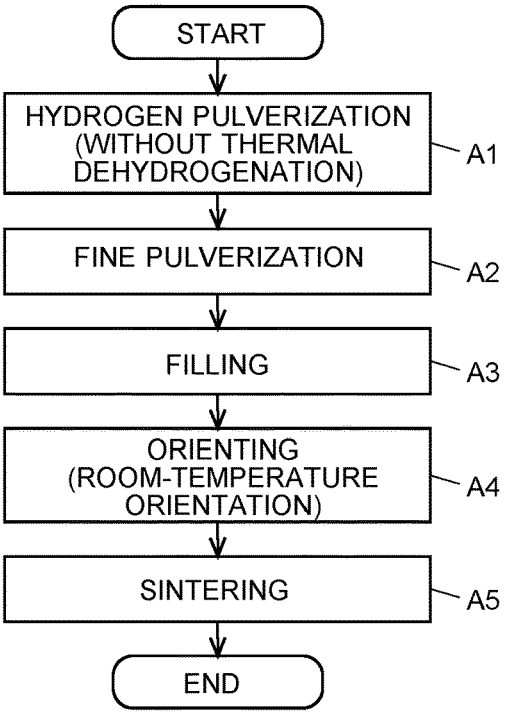
FIG. 1 is a flowchart showing one example of the method for producing a NdFeB system sintered magnet according to the present invention.

As shown in FIG. 1, the method for producing a NdFeB system sintered magnet according to the present example includes: a hydrogen pulverization process (Step A1), in which a NdFeB system alloy prepared beforehand by a strip cast method is coarsely pulverized by making the alloy occlude hydrogen; a fine pulverization process (Step A2), in which 0.05-0.1 wt % of methyl caprylate or similar lubricant is mixed in the NdFeB system alloy that has not undergone thermal dehydrogenation after being hydrogen-pulverized in the hydrogen pulverization process, and the alloy is finely pulverized in a nitrogen gas stream by a jet mill so that the grain size of the alloy will be equal to or smaller than 3.2 μm in terms of the median ($D_{50}$) of the grain size distribution measured by a laser diffraction method; a filling process (Step A3), in which 0.05-0.15 wt % of methyl laurate or similar lubricant is mixed in the finely pulverized alloy powder and the mixture is put in a mold (filling container) at a density of 3.0-3.5 g/cm$^3$; an orienting process (Step A4), in which the alloy powder held in the mold is oriented in a magnetic field at room temperature; and a sintering process (Step A5), in which the oriented alloy powder in the mold is sintered.

The processes of Steps A3 through A5 are performed as a press-less process. The entire processes from Steps A1 through A5 are performed in an oxygen-free atmosphere.

Figure 2:
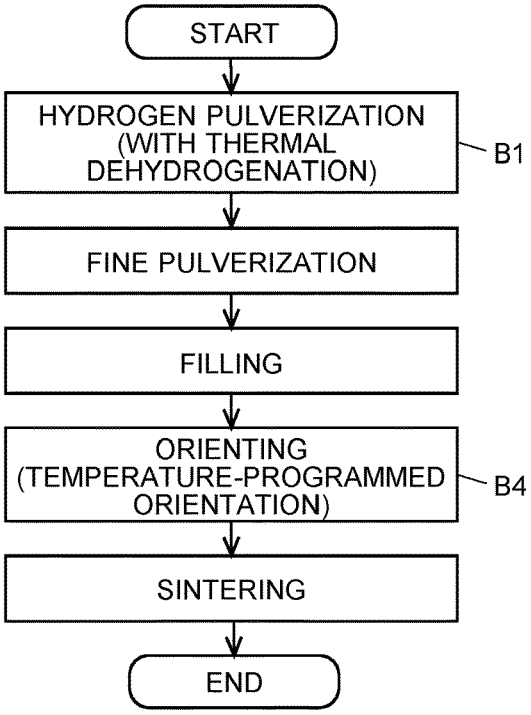
FIG. 2 is a flowchart showing a method for producing a NdFeB system sintered magnet according to a comparative example.

As shown in FIG. 2, the method for producing a NdFeB system sintered magnet according to the comparative example is the same as shown by the flowchart of FIG. 1 except for the hydrogen pulverization process (Step B1), in which thermal dehydrogenation for desorbing the hydrogen is performed after the NdFeB system alloy has been made to occlude hydrogen, as well as the orienting process (Step B4), in which a temperature-programmed orientation for heating the alloy powder is performed before, after or in the middle of the magnetic-field orientation.

The temperature-programmed orientation is a technique in which the alloy powder is heated in the orienting process so as to lower the coercive force of each individual grain of the alloy powder and thereby suppress the mutual repulsion of the grains after the orientation. By this technique, it is possible to improve the degree of orientation of the NdFeB system sintered magnet after the production.

Figure 3:
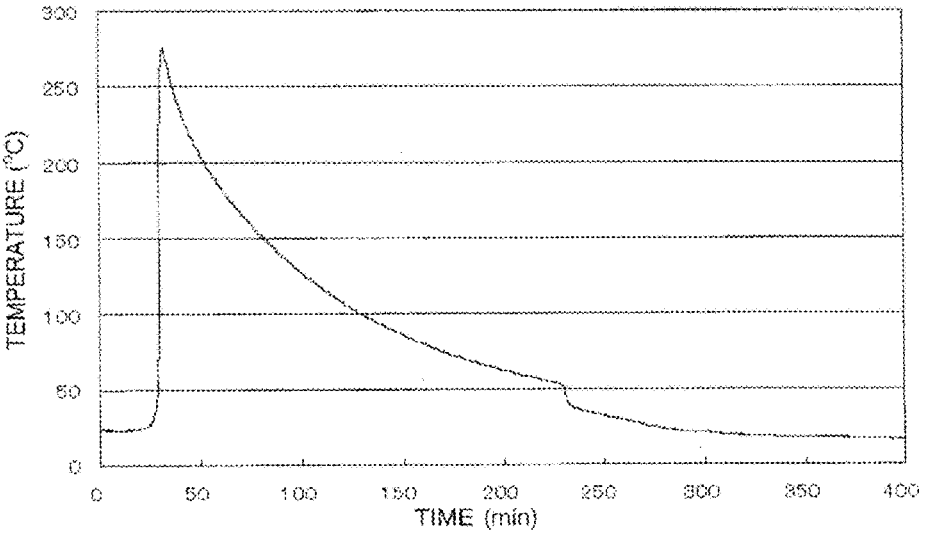
FIG. 3 is a graph showing a temperature history of a hydrogen pulverization process in the method for producing a NdFeB system sintered magnet according to the present example.

A difference between the method of producing a NdFeB system sintered magnet according to the present example and the method according to the comparative example is hereinafter described with reference to the temperature history of the hydrogen pulverization process. FIG. 3 is the temperature history of the hydrogen pulverization process (Step A1) in the method for producing a NdFeB system sintered magnet according to the present invention, and FIG.

4 is the temperature history of the hydrogen pulverization process (Step B1) in the method for producing a NdFeB system sintered magnet according to the comparative example.

Figure 4:
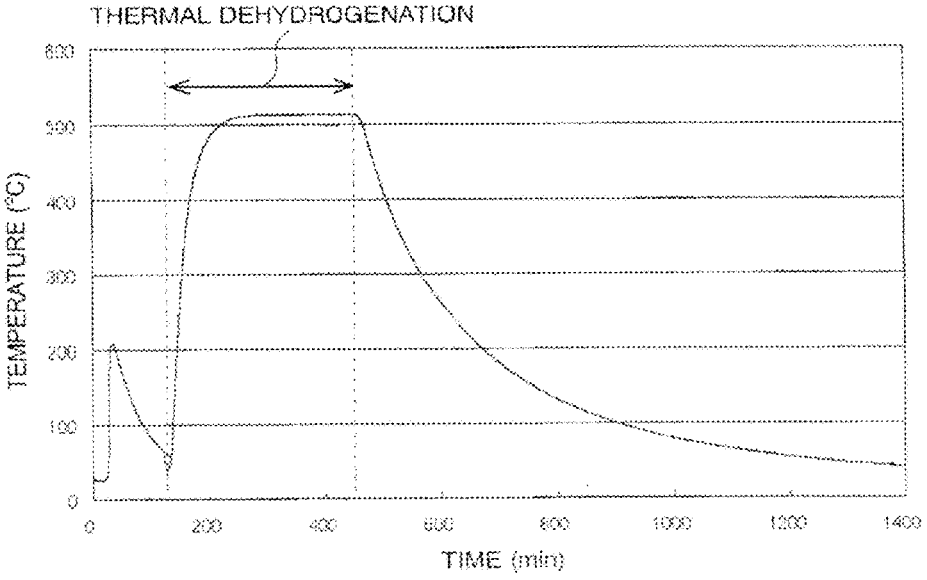
FIG. 4 is a graph showing a temperature history of a hydrogen pulverization process in the method for producing a NdFeB system sintered magnet according to the comparative example.

FIG. 4 is a temperature history of a general hydrogen pulverization process in which thermal dehydrogenation is performed. In the hydrogen pulverization process, a slice of the NdFeB system alloy is made to occlude hydrogen. This hydrogen occlusion process is an exoergic reaction and causes the temperature of the NdFeB system alloy to rise to approximately 200-300 degrees Celsius. Subsequently, the alloy is naturally cooled to room temperature while being vacuum-deaerated. In the meantime, the hydrogen occluded in the alloy expands, causing a large number of cracks inside the alloy, whereby the alloy is pulverized. In this process, a portion of the hydrogen reacts with the alloy. In order to desorb this hydrogen which has reacted with the alloy, the alloy is heated to approximately 500 degrees Celsius and then naturally cooled to room temperature. In the example of FIG. 4, the entire hydrogen pulverization process requires approximately 1400 minutes, including the period of time for the desorption of the hydrogen.

By contrast, the method for producing a NdFeB system sintered magnet according to the present example does not use the thermal dehydrogenation. Therefore, as shown in FIG. 3, even if a somewhat longer period of time is assigned for cooling the alloy to room temperature while performing the vacuum deaeration after the temperature rise due to the exoergic reaction, the hydrogen pulverization process can be completed in approximately 400 minutes. The production time is about 1000 minutes (16.7 hours) shorter than in the case of FIG. 4.

Thus, with the method for producing a NdFeB system sintered magnet according to the present example, it is possible to simplify the production process as well as significantly reduce the production time.

For each of the alloys having the compositions shown in Table 1 as Composition Numbers 1-4, the method for producing a NdFeB system sintered magnet according to the present example and the method for producing a NdFeB system sintered magnet according to the comparative example were applied. The results were as shown in Table 2.

Each of the results shown in Table 2 were obtained under the condition that the grain size of the alloy powder after the fine pulverization was controlled to be 2.82 μm in terms of $D_{50}$ measured by a laser diffraction method. A 100 AFG-type jet mill manufactured by Hosokawa Micron Corporation was used as the jet mill for the fine pulverization process. A magnetic characteristics measurement device manufactured by Nihon Denji Sokki co., ltd (product name: Pulse BH Curve Tracer PBH-1000) was used for the measurement of the magnetic characteristics.

In Table 2, the data of "Dehydrogenation: No" and "Temperature-Programmed Orientation: No" show the results of the method for producing a NdFeB system sintered magnet according to the present example, while the data of "Dehydrogenation: Yes" and "Temperature-Programmed Orientation: Yes" show the results of the method for producing a NdFeB system sintered magnet according to the comparative example.

TABLE 1

| Composition No. | Nd | Pr | Dy | Co | B | Al | Cu | Fe |
|---|---|---|---|---|---|---|---|---|
| 1 | 25.8 | 4.88 | 0.29 | 0.99 | 0.94 | 0.22 | 0.11 | bal. |
| 2 | 24.7 | 5.18 | 1.15 | 0.98 | 0.94 | 0.22 | 0.11 | bal. |
| 3 | 23.6 | 5.08 | 2.43 | 0.98 | 0.95 | 0.19 | 0.12 | bal. |
| 4 | 22.0 | 5.17 | 3.88 | 0.99 | 0.95 | 0.21 | 0.11 | bal. |

TABLE 2

| Composition No. | Dehydrogenation | Pulverization Rate (g/min) | Temperature-Programmed Orientation | Sintering Temperature (° C.) | HcJ (kOe) | Br/Js (%) |
|---|---|---|---|---|---|---|
| 1 | Yes | | Yes | 1005 | 15.50 | 96.1 |
| 1 | No | 30.7 | No | 985 | 15.68 | 96.0 |
| 2 | Yes | 19.9 | Yes | 1005 | 16.25 | 95.2 |
| 2 | No | 31.7 | No | 985 | 17.71 | 95.5 |
| 3 | Yes | 19.7 | Yes | 1005 | 17.79 | 95.2 |
| 3 | No | 30.0 | No | 985 | 20.12 | 95.8 |
| 4 | Yes | 17.7 | Yes | 1015 | 20.49 | 95.6 |
| 4 | No | 25.7 | No | 1010 | 21.86 | 96.6 |

As shown in Table 2, when the thermal dehydrogenation was not performed, the pulverization rate of the alloy in the fine pulverization process was higher than in the case where the thermal dehydrogenation was performed, regardless of which composition of the alloy was used. This is probably because, in the case where the thermal dehydrogenation is performed, the structure inside the alloy which has been embrittled due to the hydrogen occlusion recovers its toughness as a result of the thermal dehydrogenation, whereas, in the case where the thermal dehydrogenation is not performed, the structure remains embrittled. Thus, the production method according to the present example in which the thermal dehydrogenation is not performed has the effect of reducing the production time as compared to the conventional method in which the thermal dehydrogenation is performed.

Although no temperature-programmed orientation was performed, the production method according to the present example achieved high degrees of orientation $B_r/J_s$ which exceeded 95% and were comparable to the levels achieved by the production method according to the comparative example in which the temperature-programmed orientation was performed. A detailed study by the present inventors has revealed the fact that the magnetic anisotropy of the grains of the alloy powder (i.e. the coercive force of each individual grain) becomes lower in the case where the thermal dehydrogenation is not performed. When the coercive force of the individual grains is low, each grain will be a multi-domain structure in which reverse magnetic domains are formed along with the weakening of the applied magnetic field after the alloy powder has been oriented. As a result, the magnetization of each grain decreases, which alleviates the deterioration in the degree of orientation due to the magnetic interaction among the neighboring grains, so that a high degree of orientation is achieved. In principle, this is the same as what occurs during the process of improving the degree of orientation of a NdFeB system sintered magnet after the production is improved through the temperature-programmed orientation.

In summary, in the method for producing a NdFeB system sintered magnet according to the present example, although the temperature-programmed orientation is not performed, a high degree of orientation can be achieved as in the case of the temperature-programmed orientation, so that the production process can be simplified and the production time can be reduced.

Each of the sintering temperatures shown in Table 2 is the temperature at which the density of a sintered body for a given combination of the composition and the production method will be closest to the theoretical density of the NdFeB system sintered magnet. As shown in Table 2, it has been found that the sintering temperature in the present example tends to be lower than in the comparative example. The decrease in the sintering temperature leads to a decrease in the energy consumption through the production of the NdFeB system sintered magnet, and therefore, to the saving of energy. Another favorable effect is the extension of the service life of the mold, which is also heated with the alloy powder.

It can also been understood from the results of Table 2 that the NdFeB system sintered magnets produced by the method according to the present example have higher coercive forces $H_{cJ}$ than the NdFeB system sintered magnets produced by the method according to the comparative example.

Subsequently, a measurement by Auger electron spectroscopy (AES) was conducted to examine the fine structure of the NdFeB system sintered magnets produced by the method according to the present example as well as that of the NdFeB system sintered magnets produced by the method according to the comparative example. The measurement device was an Auger microprobe manufactured by JEOL Ltd. (product name: JAMP-9500F).

A brief description of the principle of the Auger electron spectroscopy is as follows: In Auger electron spectroscopy, an electron beam is cast onto the surface of a target object, and the energy distribution of Auger electrons produced by the interactions between the electrons and the atoms irradiated with those electrons is determined. An Auger electron has an energy value specific to each element. Therefore, it is possible to identify the elements existing on the surface of the target object (more specifically, in the region from the surface to a depth of a few nanometers) by analyzing the energy distribution of the Auger electrons (qualitative analysis). It is also possible to quantify the amounts of elements from the ratios of their peak intensities (quantitative analysis).

The distribution of the elements in the depth direction of the target object can be determined by an ion-sputtering of the surface of the target object (e.g. by a sputtering process using Ar ions).

The actual method of analysis was as follows: To remove contaminations from the surface of a sample, the sputtering of the sample surface was performed for 2-3 minutes before the actual measurement, with the sample inclined at an angle for the Ar sputtering (30 degrees from the horizontal plane). Next, an Auger spectrum was acquired at a few points of Nd-rich phase in the grain-boundary triple point where C and O could be detected. Based on the spectrum, a detection threshold was determined (ROI setting). The spectrum-acquiring conditions were 20 kV in voltage, $2\times10^{-8}$ A in electric current, and 55 degrees in angle (from the horizontal surface). Subsequently, the actual measurement was performed under the same conditions to acquire Auger images for Nd and C.

Figure 5A:
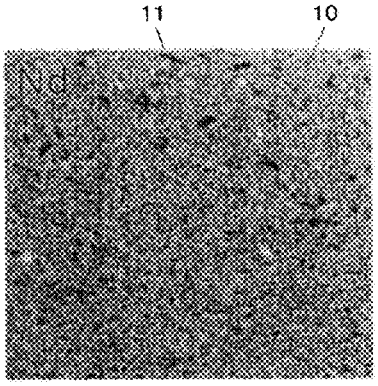
FIGS. 5A-5D are mapping images obtained by Auger electron spectroscopy on a magnet surface of one example of the NdFeB system sintered magnet according to the present invention, which was produced by the method for producing a NdFeB system sintered magnet according to the present example.
Figure 5C:
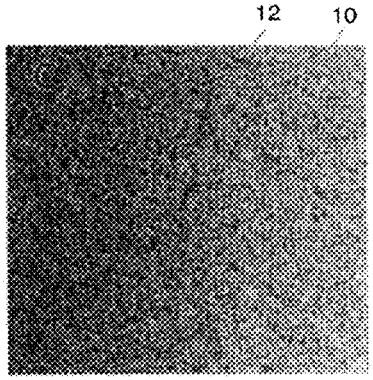
Figure 5B:
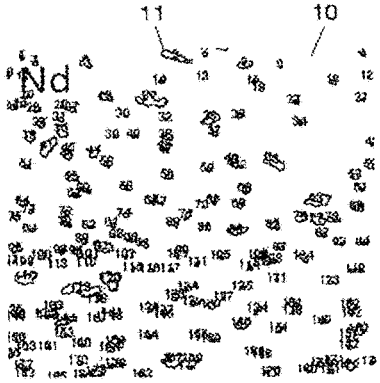
Figure 5D:
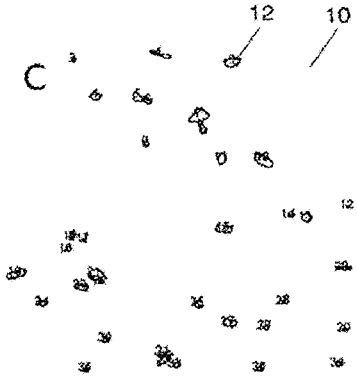
Figure 6A:
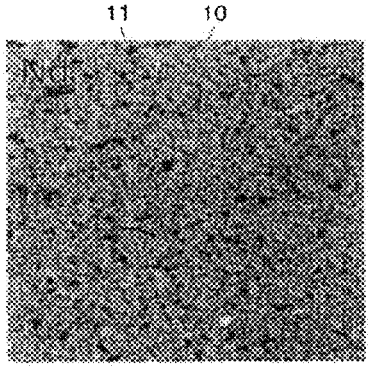
FIGS. 6A-6D are mapping images obtained by Auger electron spectroscopy on the surface of a NdFeB system sintered magnet produced by the method for producing a NdFeB system sintered magnet according to the comparative example.
Figure 6C:
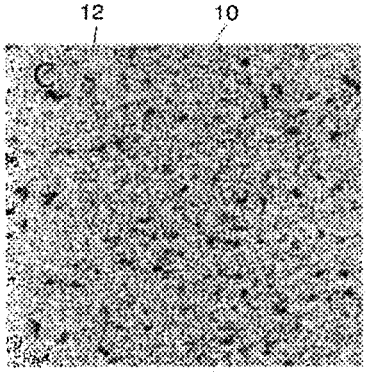
Figure 6B:
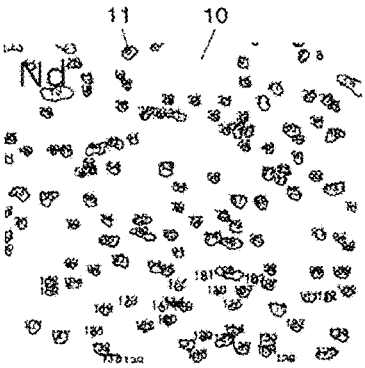
Figure 6D:
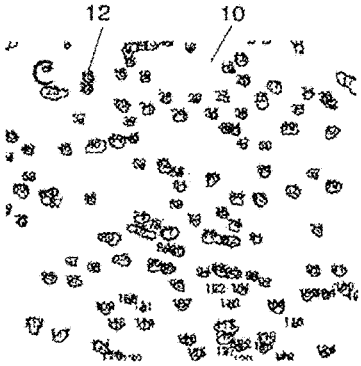

In the present analysis, Auger images of Nd and C (FIGS. 5A-5D and 6A-6D) were acquired by scanning the surface 10 of each of the NdFeB system sintered magnets produced from the alloy of Composition Number 2 in Table 1 by the methods of the present example and the comparative example. Actually, Nd was present almost over the entire surface of the NdFeB system sintered magnets (FIGS. 5A and 6A), from which the region 11 with the Nd content higher than the average value over the entire NdFeB system sintered magnet was extracted by an image processing as the Nd-rich grain-boundary triple-point region (FIGS. 5B and 6B). C-rich regions 12 (FIGS. 5D and 6D) were also extracted from the images of FIGS. 5C and 6C.

After the aforementioned regions were extracted, the total area of the Nd-rich grain-boundary triple-point region 11 and that of the C-rich areas 12 located in the Nd-rich grain-boundary triple-point region 11 were calculated. The calculated areas were defined as the volumes of the respective regions, and the ratio C/Nd of the two regions was calculated. Such an image processing and calculation was performed for each of a plurality of visual fields.

Figure 7:
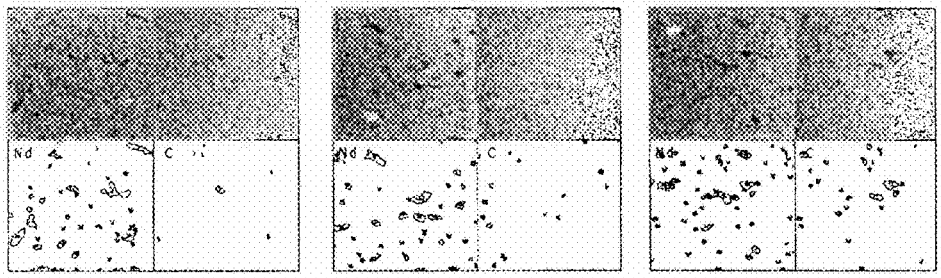
FIG. 7 shows mapping images obtained by Auger electron spectroscopy on the surface of the NdFeB system sintered magnet of the present example.
Figure 8:
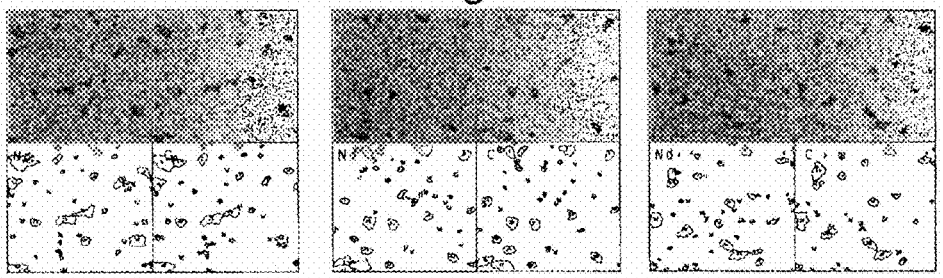
FIG. 8 shows mapping images obtained by Auger electron spectroscopy on the surface of a NdFeB system sintered magnet produced by the method for producing a NdFeB system sintered magnet according to the comparative example.

The surface of each of the NdFeB system sintered magnets of the present and comparative examples produced from Composition Number 2 were divided into small areas of 24 μm×24 μm, and the distributions of Nd and C as well as the C/Nd ratio were analyzed for each small area. FIGS. 7 and 8 show the result of the analysis. (It should be noted that each of FIGS. 7 and 8 show only three small areas which are representative).

In the case of the NdFeB system sintered magnet of the present example, the C/Nd ratio was equal to or lower than 20% in most of the small areas. Although the C/Nd ratio reached 50% in some of the small areas, none of the small areas had a C/Nd ratio over 50%. The C/Nd ratio over the entire area (the entire group of the small areas) was 26.5%.

In the case of the NdFeB system sintered magnet of the comparative example, the C/Nd ratio was as high as 90% or even higher in almost all the small areas. The C/Nd ratio over the entire area was 93.1%.

In the following description, a NdFeB system sintered magnet in which the volume ratio of the C-rich regions to the Nd-rich grain-boundary triple-point regions is equal to or lower than 50% is called the "NdFeB system sintered magnet of the present example." Furthermore, a NdFeB system sintered magnet which does not have this characteristic is called the "NdFeB system sintered magnet of the comparative example."

Figure 9:
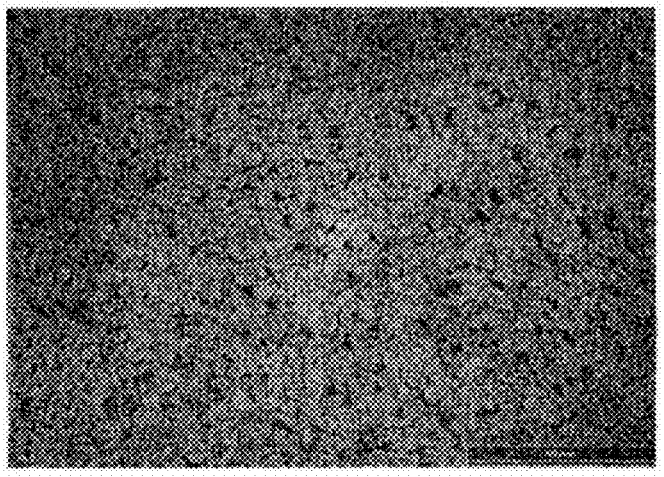
FIG. 9 is an optical micrograph of the NdFeB system sintered magnet of the present example.

The carbon content of the NdFeB system sintered magnet takes approximately the same value for each production method. The carbon content of a NdFeB system sintered magnet corresponding to Composition Number 3 in Table 1, which was measured by using the CS-230 type carbon-sulfur analyzer manufactured by LECO Corporation, was approximately 1100 ppm for a magnet produced by the method according to the comparative example and approximately 800 ppm for a magnet produced by the method according to the present example. A grain-size distribution of each of the NdFeB system sintered magnets produced by the method according to the present example was also determined by taking micrographs of the magnet within a plurality of visual fields (FIG. 9 shows one of those optical micrographs) and analyzing those micrographs by using an image analyzer (LUZEX AP, manufactured by Nireco Corporation). The average grain sizes of the main-phase grains were within a range from 2.6 to 2.9 μm.

Tables 3 and 4 show the magnetic characteristics of the NdFeB system sintered magnets of the present example and those of the NdFeB system sintered magnets of the comparative example, as well as their magnetic characteristics of after they have been employed as base materials for the grain boundary diffusion method.

Present Examples 1-4 in Table 3 are NdFeB system sintered magnets which were respectively produced from the alloys of Composition Numbers 1-4 by the method according to the present example, each magnet measuring 7 mm in length, 7 mm in width and 3 mm in thickness, with the direction of magnetization coinciding with the thickness direction. Comparative Examples 1-4 in Table 4 are NdFeB system sintered magnets which were respectively produced from the alloys of Composition Numbers 1-4 by the method according to the comparative example, with the same size as Present Examples 1-4. Each of these NdFeB system sintered magnets of Present Examples 1-4 and Comparative Examples was used as a base material for the grain boundary diffusion method, as will be described later.

TABLE 3

| Sample Name | Br (kG) | HcJ (kOe) | HcB (kOe) | BHMax (MGOe) | Js (kG) | SQ (%) | Br/Js (%) |
|---|---|---|---|---|---|---|---|
| Present Example 1 | 14.24 | 15.68 | 13.92 | 49.60 | 14.83 | 96.5 | 96.0 |
| Present Example 2 | 13.94 | 17.71 | 13.60 | 47.53 | 14.59 | 95.5 | 95.5 |
| Present Example 3 | 13.66 | 20.12 | 13.06 | 45.07 | 14.25 | 94.8 | 95.8 |
| Present Example 4 | 13.56 | 21.86 | 13.26 | 44.56 | 14.04 | 95.1 | 96.6 |
| Comparative Example 1 | 14.27 | 15.50 | 13.80 | 50.10 | 14.86 | 89.9 | 96.1 |
| Comparative Example 2 | 13.93 | 16.25 | 13.27 | 47.11 | 14.63 | 91.4 | 95.2 |
| Comparative Example 3 | 13.70 | 17.79 | 13.21 | 45.62 | 14.39 | 92.1 | 95.2 |
| Comparative Example 4 | 13.44 | 20.49 | 12.93 | 43.21 | 14.06 | 93.8 | 95.6 |

In this table, $B_r$ is the residual magnetic flux density (the magnitude of the magnetization J or magnetic flux B at a magnetic field of H=0 on the magnetization curve (J-H curve) or demagnetization curve (B-H curve)), $J_s$ is the saturation magnetization (the maximum value of the magnetization J), $H_{cB}$ is the coercive force defined by the demagnetization curve, $H_{cJ}$ is the coercive force defined by the magnetization curve, $(BH)_{max}$ is the maximum energy product (the maximum value of the product of the magnetic flux density B and the magnetic field H on the demagnetization curve), $B_r/J_s$ is the degree of orientation, and SQ is the squareness ratio. Larger values of these properties mean better magnetic characteristics.

As shown in Table 3, when the composition is the same, the NdFeB system sintered magnet of the present example has a higher coercive force $H_{cJ}$ than the NdFeB system sintered magnet of the comparative example. There is no significant difference in the degree of orientation $B_r/J_s$. However, as for the squareness ratio SQ, the NdFeB system sintered magnets of the present example has achieved extremely high values as compared to the NdFeB system sintered magnets of the comparative example.

Table 4 below shows the magnetic characteristics after the grain boundary diffusion treatment was performed using each of the NdFeB system sintered magnets shown in Table 3 as the base material and using Tb as $R_H$.

TABLE 4

| Sample Name | Br (kG) | HcJ (kOe) | HcB (kOe) | BHMax (MGOe) | Js (kG) | SQ (%) | Br/Js (%) |
|---|---|---|---|---|---|---|---|
| Present Example 1 | 14.02 | 25.04 | 13.76 | 48.11 | 14.63 | 96.2 | 95.9 |
| Present Example 2 | 13.72 | 28.01 | 13.28 | 45.70 | 14.29 | 95.6 | 96.3 |

TABLE 4-continued

| Sample Name | Br (kG) | HcJ (kOe) | HcB (kOe) | BHMax (MGOe) | Js (kG) | SQ (%) | Br/Js (%) |
|---|---|---|---|---|---|---|---|
| Present Example 3 | 13.55 | 31.39 | 13.14 | 44.84 | 14.09 | 95.0 | 95.7 |
| Present Example 4 | 13.38 | 32.60 | 13.08 | 43.79 | 13.89 | 95.6 | 96.4 |
| Comparative Example 1 | 13.98 | 24.60 | 13.66 | 47.88 | 14.04 | 86.6 | 96.0 |
| Comparative Example 2 | 13.65 | 25.53 | 13.19 | 45.67 | 14.26 | 88.1 | 95.7 |
| Comparative Example 3 | 13.57 | 27.69 | 13.13 | 44.94 | 14.22 | 89.5 | 95.4 |
| Comparative Example 4 | 13.20 | 29.81 | 12.84 | 41.67 | 13.84 | 88.3 | 95.5 |

The grain boundary diffusion (GBD) treatment was performed as follows:

A TbNiAl alloy powder composed of 92 wt % of Tb, 4.3 wt % of Ni and 3.7 wt % of A1 was mixed with a silicon grease by a weight ratio of 80:20. Then, 0.07 g of silicon oil was added to 10 g of the aforementioned mixture to obtain a paste, and 10 mg of this paste was applied to each of the two magnetic pole faces (7 mm×7 mm in size) of the base material.

After the paste was applied, the rectangular base material which was placed on a molybdenum tray provided with a plurality of pointed supports. The rectangular base material, being held by the supports, was heated in a vacuum of $10^{-4}$ Pa. The heating temperature was 880 degrees Celsius, and the heating time was 10 hours. Subsequently, the base material was quenched to room temperature, after which it was heated at 500 degrees Celsius for two hours and then once more quenched to room temperature.

As shown in Table 4, the magnets obtained by performing a grain boundary diffusion treatment using the NdFeB system sintered magnets of the present example as the base material had much higher coercive forces $H_{cJ}$ than the sintered magnets of the comparative example obtained by performing a grain boundary diffusion treatment using the NdFeB system sintered magnets of the comparative example as the base material. Furthermore, in the case where the NdFeB system sintered magnets of the comparative example were used as the base material, the squareness ratio SQ significantly deteriorated through the grain boundary diffusion treatment, whereas, in the case where the NdFeB system sintered magnets of the present example were used as the base material, the squareness ratio SQ barely deteriorated; it rather became higher in some cases.

The amounts of decrease in the maximum energy product $(BH)_{max}$ through the grain boundary diffusion treatment for the base materials of Present Examples 1-4 were 1.49 MGOe, 1.83 MGOe, 0.23 MGOe and 0.77 MGOe, respectively, while the values for the base materials of Comparative Examples 1-4 were 2.22 MGOe, 1.44 MGOe, 0.68 MGOe and 1.54 MGOe, respectively.

A comparison of these values demonstrates that, in the case of the NdFeB system sintered magnet of Present Example 2, the decrease in the maximum energy product after the grain boundary diffusion treatment was larger than that of the NdFeB system sintered magnet of Comparative Example 2 produced from the same starting alloy. However, in any of the other cases, the NdFeB system sintered magnet of the present example showed a smaller decrease in the maximum energy product than the NdFeB system sintered magnet of the comparative example produced from the starting alloy of the same composition. Furthermore, the amount of decrease was nearly one half of that of the comparative example.

Thus, in many cases, the NdFeB system sintered magnet of the present example undergoes a smaller decrease in the maximum energy product $(BH)_{max}$ after the grain boundary diffusion treatment than the NdFeB system sintered magnet of the comparative example produced from the starting alloy of the same composition.

The present inventors also measured the Tb content distribution in the grain boundary of the NdFeB system sintered magnet after the grain boundary diffusion treatment (which is hereinafter called the "GBD-treated magnet"), and particularly the Tb content distribution at the grain-boundary triple points and the two-grain boundary portions, for both the present example and the comparative example.

Figure 10:
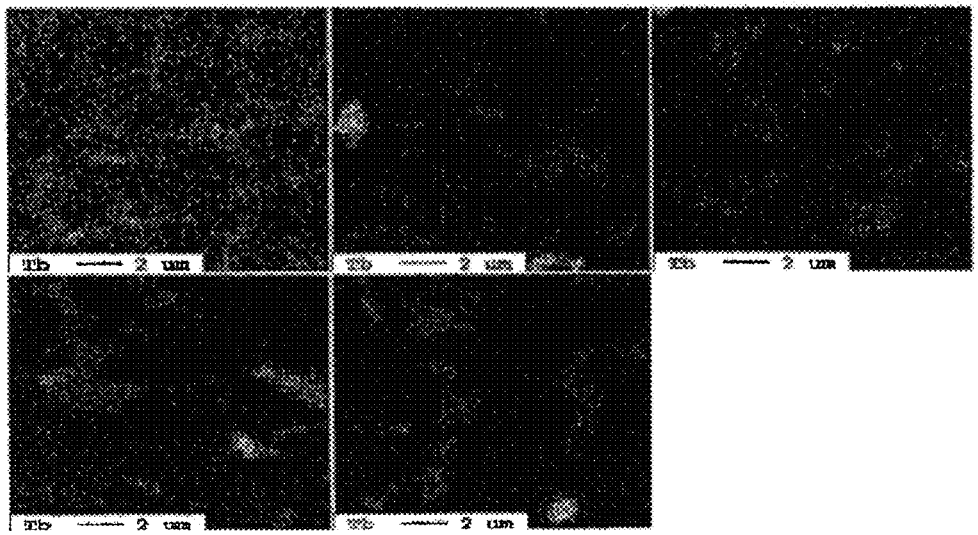
FIG. 10 shows WDS mapping images at a depth of 1 mm from a Tb-application surface of a NdFeB system sintered magnet of the present example after the grain boundary diffusion treatment.
Figure 11:
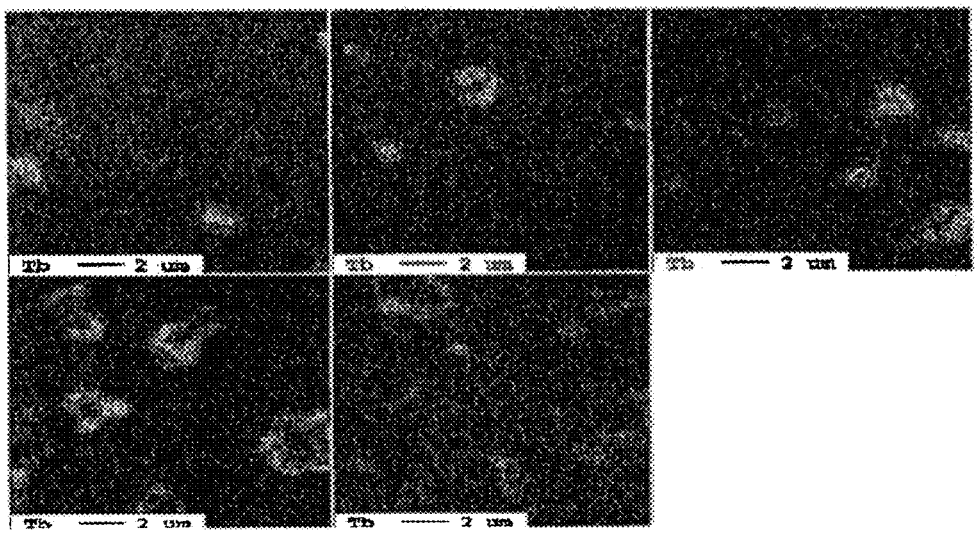
FIG. 11 shows WDS mapping images at a depth of 1 mm from a Tb-application surface of a NdFeB system sintered magnet of the comparative example after the grain boundary diffusion treatment.

FIGS. 10 and 11 show WDS (wavelength dispersion spectrometry) mapping images of GBD-treated magnets of the present example and the comparative example corresponding to Composition Number 2. The images were obtained by cutting each magnet at a depth of 1 mm from a magnetic pole face (Tb-application surface) in a plane parallel to the magnetic pole face by means of a cutting machine with a peripheral cutting edge and then detecting Tb on the cut surface by a WDS analysis of with an EPMA (JXA-8500F, manufactured by JEOL Ltd.) after polishing the same surface. The measurement conditions were: an acceleration voltage of 15 kV, a WDS analysis, a dispersive crystal LIFH (TbLα), and the probe diameter being equal to the resolving power of the device. The raw data of the X-ray count by the EPMA were converted into the Tb content. The calibration curve used for this conversion was created by performing a quantitative analysis in the vicinity of the Tb-application surface where the Tb content was highest as well as on the opposite surface where the Tb content was low. In these figures, the Tb content is represented by the degree of shading (brighter areas have higher contents).

A comparison of the WDS mapping images of the GBD-treated magnet of the present example shown in FIG. 10 with those of the GBD-treated magnet of the comparative example shown in FIG. 11 demonstrates that, in FIG. 11, a comparatively large number of white areas indicating high Tb contents (these areas correspond to the grain-boundary triple points) can be seen, with a noticeable variation in the brightness, whereas, in FIG. 10, such areas can barely be seen and the variation in the brightness is small.

Figure 12:
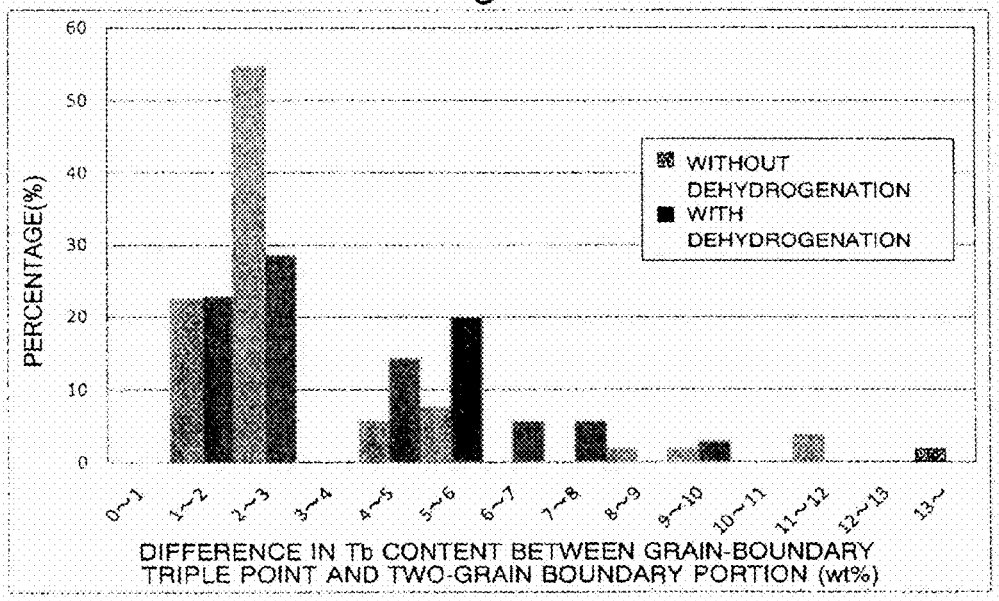
FIG. 12 is a histogram showing the content difference between grain-boundary triple points and two-grain boundary portions leading to those grain boundary triple points in the NdFeB system sintered magnets of the present example and the comparative example after the grain boundary diffusion treatment.

For each grain-boundary triple point in the GBD-treated magnets of the present example and the comparative example, the difference between the highest value of the Tb content at that grain-boundary triple point and the lowest value of the Tb content in the two-grain boundary portion leading to that grain-boundary triple point was calculated, and a histogram showing the content difference for each grain-boundary triple point was created. The result was as shown in FIG. 12. From this histogram of FIG. 12, it has been found that, in the case of the GBD-treated magnet of the present example (the result of "Without Dehydrogenation Process" in FIG. 12), the percentage of the grain-boundary triple points at which the Tb content difference between the grain-boundary triple point and the two-grain boundary portion is within a range from 2 to 3 wt % is higher than 50%. It has also be found that the percentage of the grain-boundary triple points at which the Tb content difference between the grain-boundary triple point and the two-grain boundary portion is equal to or lower than 3% exceeds 60%.

By contrast, in the case of the GBD-treated magnet of the comparative example (the result of "With Dehydrogenation Process" in FIG. 12), the percentage of the grain-boundary triple points at which the Tb content difference between the grain-boundary triple point and the two-grain boundary portion is within a range from 4 to 6% is comparatively high. Thus, it has been found that the GBD-treated magnet of the comparative example is inferior to that of the present example in terms of the uniformity of the Tb content in the grain boundary.

The present inventors also conducted a measurement on the diffusion of Tb in the depth direction from the Tb-application surface of each of the GBD-treated magnets of the present example and the comparative example.

In this measurement, the following processes were performed: Initially, a base material corresponding to Composition Number 2 (a sintered body before the grain boundary diffusion treatment) was oxidized except for one magnetic pole face. Subsequently, Tb was applied to the non-oxidized magnetic pole face, and the grain boundary diffusion treatment was performed. The NdFeB system sintered magnet after the grain boundary diffusion treatment (GBD-treated magnet) was cut at a plane perpendicular to the magnetic pole faces. A linear analysis of the Tb content was performed with an EPMA along a straight line parallel to the depth direction on the cut surface. The linear analysis was performed from the Tb-application surface to the opposite end under the same measurement conditions as described previously. For each sample, data were acquired along five lines spaced at intervals that could be resolved by the device. The five sets of data were superposed on each other to create a graph showing the Tb content in the depth direction. The conversion of data into the Tb content was performed by the same method as used for obtaining the images of FIGS. 10 and 11. The results were as shown in FIGS. 13 and 14.

In each of the graphs of FIGS. 13 and 14, the spike-like portions with high contents (which are hereinafter called the "peaks") show the Tb content in the grain boundary, while the other portions with low contents show the Tb content in the main-phase grains. The curve $C_{gx}$ in the drawings is an exponential decay curve which approximates a curve that is in contact with the tops of the peaks. This curve shows the change in the Tb content in the grain boundary with respect to the distance (depth) from the Tb-application surface. On the other hand, the curve $C_x$ in the drawings is an exponential decay curve which approximates a curve that is in contact with each point between of the peaks. This curve shows the change in the Tb content in the main-phase grains with respect to the distance from the Tb-application surface.

Figure 13:
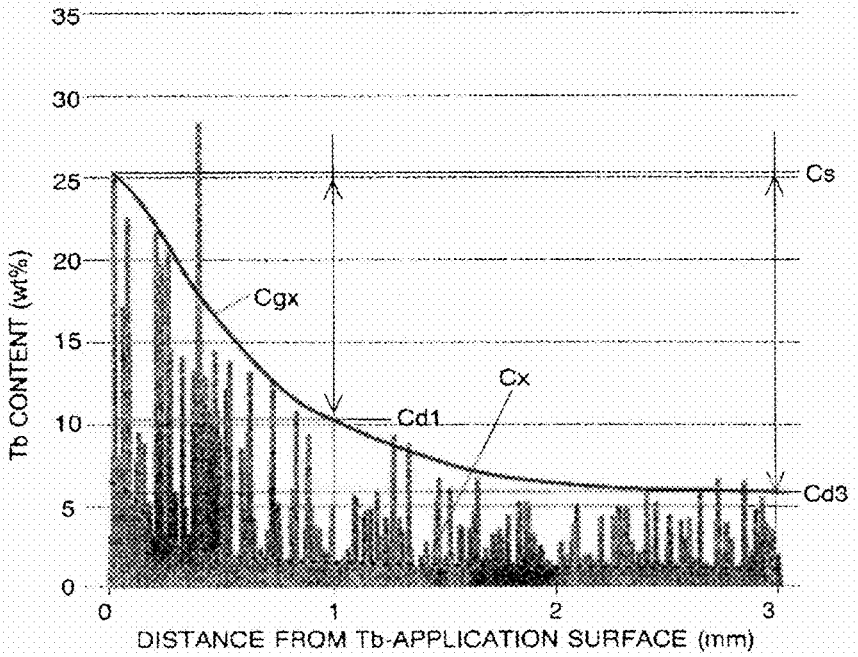
FIG. 13 is a chart showing the result of a linear analysis in which the Tb content distribution on a cut surface perpendicular to the Tb-application surface of the NdFeB system sintered magnet of the present example after the grain boundary diffusion treatment was measured with respect to the distance from the same surface (in the depth direction).
Figure 14:
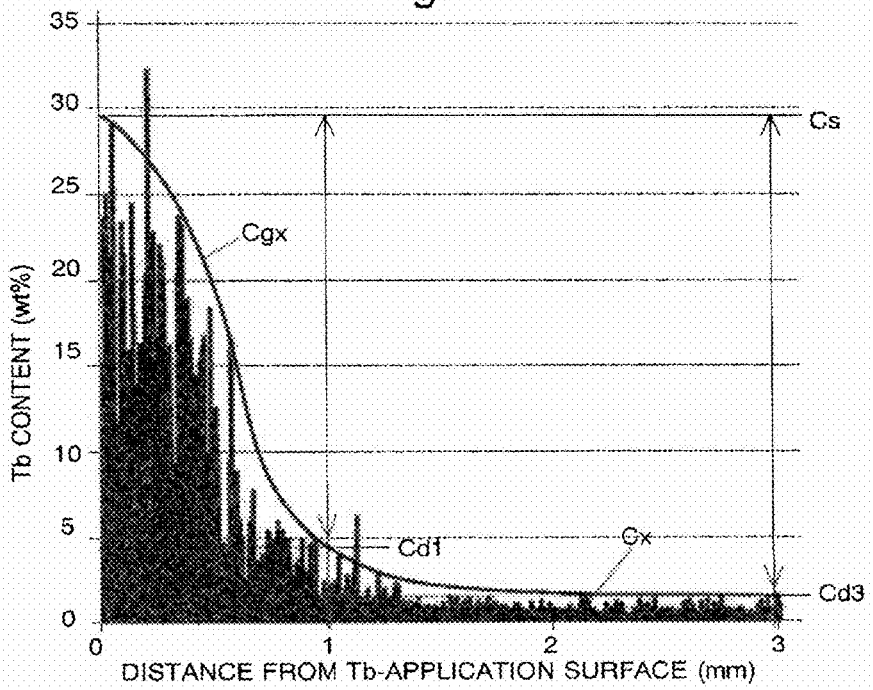
FIG. 14 is a chart showing the result of a linear analysis in which the Tb content distribution on a cut surface perpendicular to the Tb-application surface of the NdFeB system sintered magnet of the comparative example after the grain boundary diffusion treatment was measured with respect to the distance from the same surface (in the depth direction).

As shown in FIGS. 13 and 14, the Tb contents $C_{gx}$ and $C_x$ basically decrease with an increase in the distance from the application surface. This decrease was more gradual in the case of the GBD-treated magnet of the present example; the Tb content $C_{gx}$ was at a comparatively high level of 5 wt % or higher even at a depth of 3 mm (i.e. on the surface opposite to the Tb-application surface). By contrast, in the case of the GBD-treated magnet of the comparative example, the Tb content $C_{gx}$ in the grain boundary at the depth of 3 mm was 2 wt % or lower.

The difference $C_s-C_{d3}$ in the Tb content $C_{gx}$ in the grain boundary between on the Tb-application surface (a depth of 0 mm) and at a depth of 3 mm from the Tb-application surface was equal to or larger than 25 wt % in the NdFeB system sintered magnet of the comparative example, while the difference was equal to or smaller than 20 wt % in the NdFeB system sintered magnet of the present example. Furthermore, the difference $C_s-C_{d1}$ in the Tb content $C_{gx}$ in the grain boundary between on the Tb-application surface and at a depth of 1 mm from the Tb-application surface was equal to or larger than 20 wt % in the NdFeB system sintered magnet of the comparative example, while the difference was equal to or smaller than 15 wt % in the NdFeB system sintered magnet of the present example.

The difference in the Tb content between the main-phase grains and the grain boundary at a depth of 3 mm (where the content difference is the smallest) was approximately 1 wt % in the NdFeB system sintered magnet of the comparative example, whereas the same difference was equal to or larger than 3 wt % in the NdFeB system sintered magnet of the present example.

The results described thus far demonstrate that, as compared to the GBD-treated magnet of the comparative example, the GBD-treated magnet of the present example has a larger amount of Tb ($R_H$) diffused in the depth direction, with only a smaller amount of Tb permeating the main-phase grains in the vicinity of the Tb-application surface. The large difference between the curves $C_{gx}$ and $C_x$ in FIG. 13 shows that the diffusion of Tb in the depth direction mostly took place through the grain boundary.

Indeed, the content $C_x$ of Tb in the main-phase grains on the Tb-application surface of the GBD-treated magnet of the present example having the aforementioned characteristics was approximately 7 wt %, while it was approximately 12 wt % in the case of the GBD-treated magnet of the comparative example. This result confirms that the GBD-treated magnet of the present example has a smaller amount of Tb permeating the main-phase grains in the vicinity of the Tb-application surface than the GBD-treated magnet of the comparative example.

Therefore, in the GBD-treated magnet of the present example, the amount of decrease in the maximum energy product is smaller than in the GBD-treated magnet of the comparative example. The fact that the GBD-treated magnet of the present example has a higher coercive force and squareness ratio than the GBD-treated magnet of the comparative example is also probably due to the even diffusion of Tb in the grain boundary.

The fact that Tb can be diffused from one Tb-application surface to a depth of 3 mm suggests that, if Tb is applied to two opposite faces of a magnet, Tb can be diffused to the center of a GBD-treated magnet whose thickness is as large as 6 mm.

In the GBD-treated magnet of the present example, the low percentage of the carbon-rich phase in the Nd-rich phase of the sintered body used as the base material allows $R_H$ to be efficiently diffused through the Nd-rich phase in the grain boundaries. An experiment conducted by the present inventors has demonstrated that, when $R_H$ is applied to two opposite faces of a magnet, $R_H$ can be diffused to the center of a sintered base material whose thickness is as large as 10 mm. Table 5 shows an increase in the coercive force from the level before the grain boundary diffusion of the GBD-treated magnets of the present example corresponding to the alloys of Composition Numbers 1 and 3 as well as the GBD-treated magnet of the comparative example corresponding to the alloy of Composition Number 2, each of which was produced with three thicknesses of 3 mm, 6 mm and 10 mm.

TABLE 5

| | Composition No. | Increase in Coercive Force (kOe) | | |
|---|---|---|---|---|
| | | 3 mm thick | 6 mm thick | 10 mm thick |
| Present Example | 1 | 9.4 | 9.0 | 6.0 |
| Present Example | 3 | 11.3 | 10.0 | 8.0 |
| Comparative Example | 2 | 9.3 | 6.5 | 3.0 |

As can be seen in this table, there is no significant difference between the GBD-treated magnets of the present example and that of the comparative example in the case of the 3-mm thickness. As the magnets become thicker, the GBD-treated magnets of the present example come to exhibit its superiority in terms of the coercive force. For example, in the case of the GBD-treated magnets of the present example, the amounts of increase in the coercive force at a thickness of 6 mm were maintained at approximately the same levels as they were at a thickness of 3 mm, whereas the amount significantly decreased in the case of the GBD-treated magnets of the comparative example. A larger increase in the coercive force suggests that $R_H$ is diffused to the center of the magnet. These results demonstrate that the GBD-treated magnets produced by the method according to the present example are suitable as a base material for producing a thick magnet having high magnetic characteristics by a grain boundary diffusion treatment.

EXPLANATION OF NUMERALS

10 . . . Surface of NdFeB System Sintered Magnet
11 . . . Region Where Nd-Rich Phase Exists
12 . . . Region Where Carbon Is Distributed

The invention claimed is:

1. A NdFeB system sintered magnet comprising:
main-phase grains; and
a rare-earth rich phase containing Dy and/or Tb at a grain boundary of the main-phase grains, the Dy and/or Tb being referred to as $R_H$,
wherein a difference $C_{gx}-C_x$ between an $R_H$ content $C_{gx}$ in the grain boundary and an $R_H$ content $C_x$ in the main-phase grains at a same depth within a range from a surface to a depth of 3 mm is equal to or larger than 3 wt %,
wherein a thickness of the NdFeB system sintered magnet is from equal to or greater than 6 mm to equal to or smaller than 10 mm, and
wherein a squareness ratio of the NdFeB system sintered magnet is equal to or greater than 95.0% and equal to or smaller than 96.2%.

2. The NdFeB system sintered magnet according to claim 1,
wherein a carbon content of the NdFeB system sintered magnet is higher than 0 ppm and equal to or lower than 1000 ppm.

3. The NdFeB system sintered magnet according to claim 1,
wherein an average grain size of the main-phase grains is equal to or smaller than 4.5 μm.

4. The NdFeB system sintered magnet according to claim 1,
wherein a percentage of a grain-boundary triple point at which the $R_H$ content difference between the grain-boundary triple point and a two-grain boundary portion leading to the grain-boundary triple point is equal to or lower than 3% exceeds 60%.

5. A NdFeB system sintered magnet comprising:

main-phase grains; and a rare-earth rich phase containing Dy and/or Tb at a grain boundary of the main-phase grains, the Dy and/or Tb being referred to as $R_H$, wherein a difference $C_{gx}-C_x$ between an RH content $C_{gx}$ in the grain boundary and an $R_H$ content $C_x$ in the main-phase grains at a same depth within a range from a surface to a depth of 3 mm is equal to or larger than 3 wt %, wherein a thickness of the NdFeB system sintered magnet is from equal to or greater than 6 mm to equal to or smaller than 10 mm, and wherein a percentage of a grain-boundary triple point at which the $R_H$ content difference between the grain-boundary triple point and a two-grain boundary portion leading to the grain-boundary triple point is equal to or lower than 3% exceeds 60%.

6. The NdFeB system sintered magnet according to claim 5, wherein a carbon content of the NdFeB system sintered magnet is higher than 0 ppm and equal to or lower than 1000 ppm.

7. The NdFeB system sintered magnet according to claim 5, wherein an average grain size of the main-phase grains is equal to or smaller than 4.5 μm.

* * * * *